United States Patent [19]

Miller

[11] Patent Number: 4,648,793

[45] Date of Patent: Mar. 10, 1987

[54] TURBINE WHEEL KEY AND KEYWAY VENTILATION

[75] Inventor: Edward H. Miller, Rexford, N.Y.

[73] Assignee: General Electric Company, Schenectady, N.Y.

[21] Appl. No.: 739,728

[22] Filed: May 31, 1985

[51] Int. Cl.[4] ..... F01D 25/32

[52] U.S. Cl. ..... 415/168; 415/115; 415/121 A

[58] Field of Search ..... 415/110–113, 415/115–117, 175, 176, 180, 168, 169 R, 169 A, 121 A, 199.5, 170 R–174; 416/93 R, 95–97, 174

[56] References Cited

U.S. PATENT DOCUMENTS

| | | | |
|---|---|---|---|
| 1,931,724 | 10/1933 | Fageol et al. | 415/111 |
| 2,656,147 | 10/1953 | Brownhill et al. | 416/97 R |
| 2,988,325 | 6/1961 | Dawson | 415/115 |
| 3,230,710 | 1/1966 | Van Nimwegen et al. | 415/172 A |
| 3,392,910 | 7/1968 | Tanzberger | 415/111 |
| 3,647,311 | 3/1972 | Wootton et al. | 415/113 |
| 4,037,985 | 7/1977 | Karassik et al. | 415/175 |
| 4,425,077 | 1/1984 | Martin | 415/115 |
| 4,465,429 | 8/1984 | Martin et al. | 415/116 |
| 4,545,725 | 10/1985 | Ikeda et al. | 415/176 |

FOREIGN PATENT DOCUMENTS

| | | | |
|---|---|---|---|
| 2740155 | 3/1978 | Fed. Rep. of Germany | 415/111 |
| 70204 | 11/1977 | Japan | 415/115 |
| 14207 | 8/1978 | Japan | 415/168 |
| 74307 | 4/1984 | Japan | 415/172 A |
| 150907 | 8/1984 | Japan | 415/175 |
| 761435 | 11/1956 | United Kingdom | 415/115 |
| 868806 | 5/1961 | United Kingdom | 416/95 |

*Primary Examiner*—Robert E. Garrett
*Assistant Examiner*—John Kwon
*Attorney, Agent, or Firm*—Jerome C. Squillaro

[57] ABSTRACT

In a steam turbine having a wheel secured to a rotatable shaft by a key and cooperating keyway, a passageway provides steam flow communication between an axial end of the keyway and a first location on an axial end of the wheel. A channel provides steam flow communication between the other axial end of the keyway and a second location on the axial end of the wheel. The first and second location are preferably diametrically opposed. Steam may be directed to enter the passageway at the first location, flow along the keyway and channel and exit at the second location, thereby ventilating the key and keyway.

21 Claims, 2 Drawing Figures

TURBINE WHEEL KEY AND KEYWAY VENTILATION

RELATED APPLICATION

This application is related to an application, Ser. No. 739,958, by Kenneth E. Robbins and Edward H. Miller entitled, "Ventilation Of Turbine Components", filed even date herewith and assigned to the present assignee.

BACKGROUND OF THE INVENTION

The invention relates to ventilation of a turbine key and keyway and, more particularly, is generally applicable to ventilation of axial keys and keyways used to secure turbine wheels to a rotatable shaft.

Some steam turbines utilize such large rotors that the turbine wheels, which carry turbine blades, or buckets, at their radially outer portions, are not an integral part of the shaft of the rotor. Each wheel of such turbines typically includes a hub section disposed generally at the radially inner portion of the wheel and each hub section includes a bore therethrough for receiving and circumferentially surrounding the shaft of the turbine.

To ensure proper and efficient operation of the turbine, it is required that turbine wheels be disposed at substantially fixed circumferential and axial locations relative to the shaft and relative to other wheels on the shaft. A wheel that is not an integral portion of the shaft may be secured to the shaft by an interference shrink fit between the radially inner surface of the hub defining the wheel bore and a cooperating surface of the shaft. Additionally, in order to decrease the likehood of axial and/or tangential (i.e. circumferential) motion of a wheel with respect to the shaft and/or to other wheels on the shaft, a key and an accommodating keyway may be used to secure the wheel to the shaft in order to augment the restraining capability of the interference shrink fit.

It has been suspected that stresses in the wheel hub due in part to the key, keyway and shrink fit, in combination with other stresses generated by normal operation of the turbine, e.g. thermal stress and load cycling, or adverse operational conditions, e.g. introduction of contaminants in the steam, may create an environment in the vicinity of the hub of the wheel which is conductive to initiating and fostering stress corrosion. The precise mechanism which produces stress corrosion is not fully understood, however, it is believed that if accumulation of water, such as is obtained from condensed steam, is minimized, along with minimizing the concentration of oxygen and other non-condensible gases, such as carbon dioxide, in steam and/or in water which contacts the hub region of the wheel, including the key and keyway, then the probability of stress corrosion occurring will be reduced, if not eliminated. Since it is crucial that steam follow the designed steam flow path through a turbine in order to obtain maximum overall turbine efficiency, any attempt to alleviate the aforementioned problems should do so with minimum interference with the main, or working, steam flow path.

Accordingly, it is an object of the present invention to provide means and method for reducing and/or eliminating build-up of oxygen and other non-condensible gas concentration in the hub area, especially in the region of the key and keyway of a turbine wheel that is not an integral part of the shaft.

It is another object of the present invention to provide means and method for reducing accumulation of water in the hub region of a turbine wheel, especially in the region of a key and keyway, wherein the wheel is not integral with the turbine shaft, and is secured to the shaft, at least in part by the key disposed in the cooperating keyway.

Still another object of the present invention to provide means and method for reducing accumulation of water in the hub region of a turbine wheel without affecting steam flow through the desired working steam flow path of the turbine.

SUMMARY OF THE INVENTION

In accordance with the present invention, in a fluid flow turbine including a rotor and at least one wheel fixedly coupled to the rotor, the at least one wheel including a surface defining a bore for receiving the rotor and having a first part of a substantially axially extending keyway terminating at the surface of the wheel and the rotor having a second part of the keyway terminating at the periphery of the rotor, the first and second part of the keyway when appropriately registered for receiving a key, ventilation means for ventilating the keyway and the key to be disposed therein, comprises first fluid flow communication means coupled to the keyway for providing fluid flow communication between the keyway and a first location on axial end of the wheel and second fluid flow communication means coupled to the keyway for providing fluid flow communication between the keyway and a second location on the axial end of the at least one wheel such that at least a part of the keyway forms a portion of the fluid flow communication from the first location to the second location. The first location is preferably substantially diametrically opposed to the second location. The second fluid flow communication means may include an annular chamber coupled to the axial end of the keyway remote from the axial end of the wheel and a channel coupled to the chamber and terminating at the second location. Further, in another aspect fluid flow may be directed along the axial end of the wheel.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
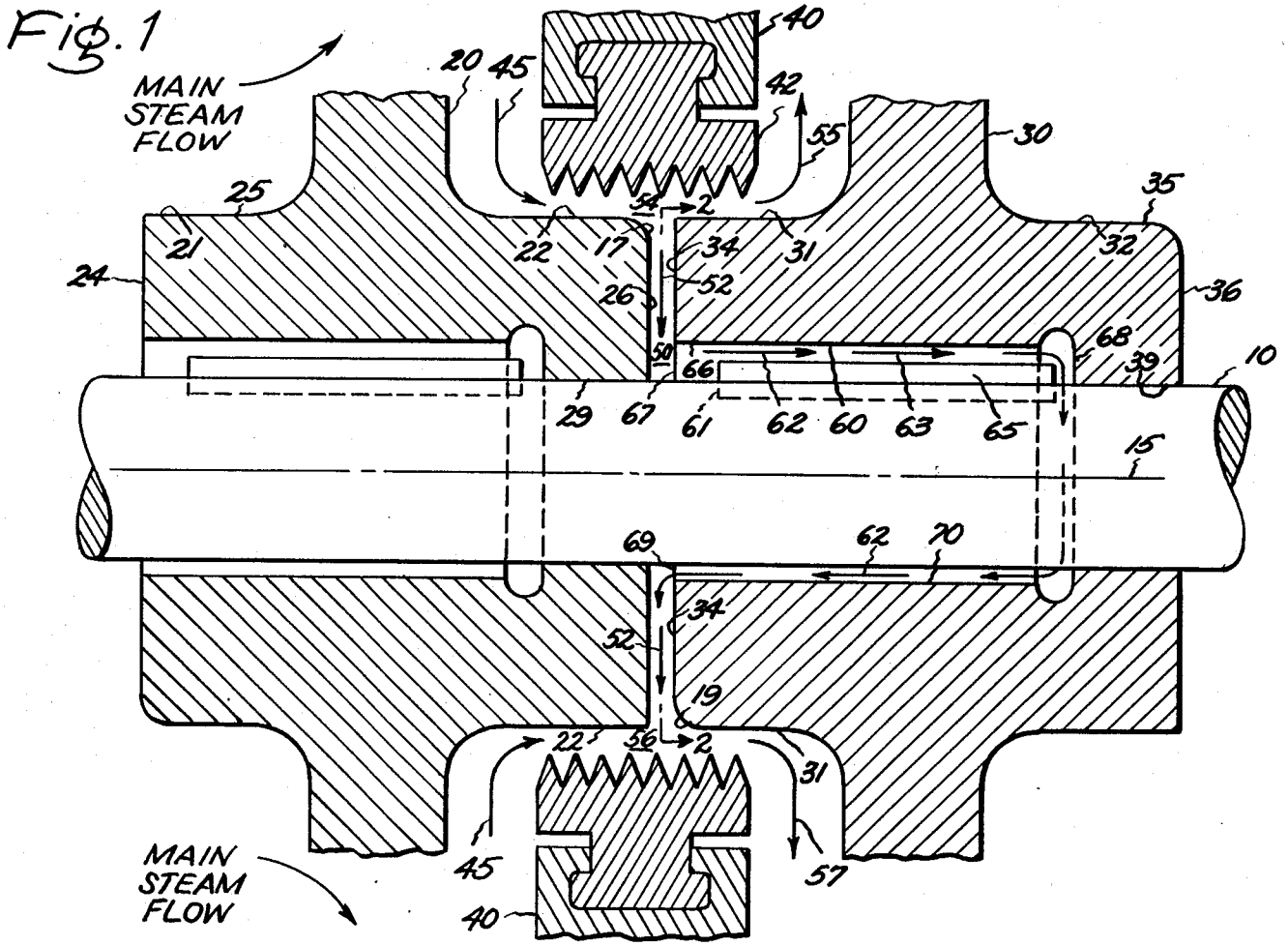
FIG. 1 is a partial sectional elevational view of a steam turbine in accordance with the present invention.
Figure 2:
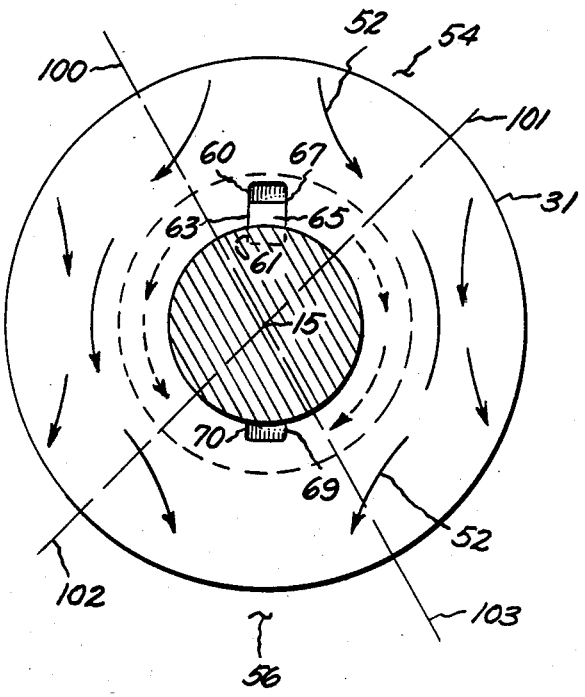
FIG. 2 is a view looking in the direction of the arrows of line 2—2 of FIG. 1.

Referring to FIGS. 1 and 2, shown in a fluid flow turbine, such as a steam turbine with a portion of shaft 10 having a center of rotation 15 and having wheels 20 and 30 affixed to the outer periphery thereof so as to rotate therewith. Surfaces 29 and 39 of respective hubs 25 and 35 of respective wheels 20 and 30 respectively define a bore for receiving shaft 10. The bore defined by surfaces 29 and 39 may be slightly smaller than the outer periphery of shaft 10 so that when assembled, wheel 20 and 30 may be secured to shaft 10 by an interference shrink fit. To further ensure that wheel 30 is adequately secured to shaft 10, an axially extending key 65 may be disposed in a keyway 63 formed from registrable keyway portions 60 and 61 respectively disposed in hub 35 of wheel 30 and shaft 10, and terminating in surface 39 and the outer periphery of shaft 10, respectively. A circumferentially extending relief annulus, or annular chamber 68 disposed in fluid flow communication with keyway 63 may be provided at the downstream (with respect to main steam flow) axial end of keyway 63. An axially extending channel 70 in hub 35 of wheel 30 terminates in surface 39 and is preferably substantially diametrically opposed to keyway 63. Channel 70 further extends between annular relief 68 and interhub spacing 50, for providing fluid flow communication between annular relief 68 and interhub spacing 50. Of course, channel 70 may be entirely disposed in shaft 10, or wheel 30 or may be partially disposed in each of shaft 10 and wheel 30.

Hub 25 of wheel 20 and hub 35 of wheel 30 axially extend along shaft 10. Hub 25 is axially spaced from hub 35 to form an interhub spacing 50 therebetween. Circumferentially surrounding a portion of hubs 25 and 35 and included interhub spacing 50 is a diaphragm assembly 40, having sealing means 42, such as a labyrinth seal, which may be integral with diaphragm assembly 40, along the radial inner portion thereof. Sealing means 42 is disposed to minimize steam leakage along the ancillary flow path indicated by arrows 45, 55 and 57 between the periphery 22 and 31 of hubs 25 and 35 and sealing means 42, so that the main steam flow will be toward the radially outer portion of wheels 20 and 30 and diaphragm 40 and thus through nozzles (not shown) formed by nozzle partitions (not shown) retained by diaphragm 40 in order to be directed into turbine blades (not shown) disposed at the radial outer portion of wheel 30. The spacing between seal 42 and periphery 22 and 31 of hubs 25 and 35 is shown enlarged in FIG. 1 for clarity. It is to be understood that this spacing is generally arranged to be as small as possible consistent with maintaining a seal between rotatable hubs 25 and 35 and stationary labyrinth seal 42. Typcially the radial extent between hub 25 and 35 and seal 42 is about 0.03 to about 0.06 inches. Wheel 20 likewise includes turbine blades (not shown) disposed at its radial outer portion.

While elements relating to wheel 30, such as keyway 63 and channel 70, have been described in detail, for ease of understanding and to avoid undue repetition, such detailed description will not be provided for wheel 20, it being understood that, as illustrated, corresponding analogous features relating to wheel 30 may be applied to wheel 20.

Although sealing means 42 severely limits steam flow along leakage path 45, 55 and 57, some steam flow will inevitably occur due to the substantial operational pressure differential across seal 42. In order to ventilate key 65 and keyway 63, it is desirable to establish a cross flow steam flow path 52 in interhub spacing 50. Various schemes may be employed to obtain cross flow 52, some of which are described and claimed in the related application entitled "Ventilation of Turbine Components" by Miller and Robbins, referenced above. Only a representative scheme for obtaining cross flow 52 will be described herein, it being understood that other methods are available.

Substantially radially extending axial end walls 26 and 34 of hubs 25 and 35 respectively define margins of interhub spacing 50. In order to encourage flow 52 through interhub spacing 50, it is desirable either to increase the static pressure of flow 45 at a pressure head recovery, or localized high pressure, region 54 and/or decrease the static pressure of flow 45 at an aspiration, or localized low pressure, region 56.

One way to increase the static pressure of flow 45 in pressure head recovery region 54 is to reduce the velocity of flow 45 as it traverses pressure head recovery region 54. The intersection 17 of end wall 26 with periphery 22 of upstream hub 25 is rounded off or radially foreshortened, or chamfered (not shown), over a predetermined arcuate portion up to 180°, such that flow 45 along periphery 22 will tend to flow radially inward at intersection 17, causing at least a portion of flow 45 to strike end wall 34 of hub 35 and resulting in a reduction in velocity in a portion of flow 45 with an attendant increase in static pressure in pressure head recovery region 54 due to well known principles of the conservation of energy. Alternatively, periphery 31 of hub 35 may be radially outwardly extended (not shown) at its intersection with end wall 34 over a predetermined arcuate portion up to 180° so that at least a portion of flow 45 will strike the extended portion of periphery 31, or an appropriate combination of rounding off at intersection 17 and radial extension of periphery 31 may be used.

One way to decrease the static pressure in aspiration region 56 is to round off or chamfer the intersection 19 of end wall 34 with periphery 31 over a predetermined arcuate portion up to 180°, such that flow 45 along periphery 22 of hub 25 will flow from greater radially extending periphery 22 to lesser radially extending intersection 19, with an attendant decrease in static pressure in aspiration region 56 due to well known principles of the conversation of energy. Alternatively, periphery 22 of hub 25 may be radially outwardly extended (not shown) at its intersection with end wall 26 over a predetermined arcuate portion up to 180°, or an appropriate combination of rounding off at intersection 19 and radial extension of periphery 22 may be used.

Pressure head recovery region 54 and aspiration region 56 are each disposed over a respective predetermined circumferential portion of hubs 25 and 35. Preferably, when both pressure head recovery region 54 and aspiration region 56 are employed, they are substantially diametrically opposed with respect to each other and have the same arcuate extent. Pressure head recovery region 54 and/or aspiration region 56 are further disposed such that flow 52 entering interhub spacing 50 from pressure head recovery region 54 (or top of hubs 25 and 35 as shown in FIG. 1) strikes the periphery of shaft 10 and a portion 62 of flow 52 is caused to flow into the entrance 67 of fluid flow communication means, or passageway, 66 which provides fluid flow communication between interhub spacing 50 and annular chamber 68 through at least a portion of keyway 63. Passageway 66 is in fluid flow communication with keyway 63 such that steam flow 62 from interhub spacing 50 flows along and past key 65 when it is disposed in keyway before reaching annular chamber 68, thereby ventilating key 65 and keyway 63 and minimizing condensation and/or oxygen or other non-condensible gas build-up or condensation in the region of key 65 and keyway 63. From annular chamber 68, steam flows through channel 70 along steam flow path 62 to enter interhub spacing 50 at exit 69 and joins steam flow 52 to exit interhub spacing 50 at aspiration region 56 (or bottom of hubs 25 and 35 as shown in FIG. 1). Exit 69 of channel 70 is disposed downstream entrance 67 of passageway with respect to flow 52. Flow 52 leaving interhub spacing 50 combines with leakage flow 45 to form flow 57 along periphery 31 of hub 35 on the downsteam side of diaphragm 40.

Thus entrance 67 of passageway 66 is preferably disposed such that it lies on an extension of the diameter of shaft 10 wherein the diameter extension intersects pressure head recovery region 54 and/or aspiration region 56. Further exit 69 of channel 70 is preferably disposed such that it lies on an extension of the diameter of shaft 10 wherein the diameter extension intersects pressure head recovery region 54 and/or aspiration region 56. In other words, assuming pressure head recovery region 54 arcuately extends between reference lines 100 and 101 of FIG. 2, then entrance 67 is preferably disposed between reference lines 100 and 101. Further, assuming aspiration region 56 arcuately extends between reference lines 102 and 103 of FIG. 2, then exit 69 is preferably disposed between reference lines 102 and 103. It is to be understood that reference line 100 need not necessarily be a diametrical extension of reference line 103 and that reference line 101 need not necessarily be a diametrical extension of reference line 102.

A method for ventilating axially disposed key 65 and keyway 63 of turbine wheel 30 includes generating fluid flow 52 along an axial end of hub 35 of wheel 30, urging at least a portion of fluid flow 52 flow along key 65 disposed in keyway 63 and returning the at least a portion of fluid flow 52 to the axial end of hub 35 at a location which is downstream with respect to fluid flow 52 of the fluid flow entrance to keyway 63.

Thus has been illustrated and described means and method for reducing accumulation of water in the hub region of a turbine wheel, which is not integral with the turbine shaft and is secured to the shaft at least in part by a key disposed in a cooperating keyway, while not affecting steam flow through the desired working steam flow path of the turbine. In addition, the means and method illustrated and described herein reduce and/or eliminate build-up of oxygen and other non-condensible gas concentration in the hub area, especially in the region of the key and keyway of a turbine wheel that is not an integral part of the shaft.

While only certain preferred features of the invention have been shown by way of illustration, many modifications and changes will occur to those skilled in the art. It is to be understood that the appended claims are intended to cover all such modifications and changes as fall within the true spirit and scope of the invention.

I claim:

1. In a fluid flow turbine including a rotatable shaft and at least one wheel fixedly coupled to the shaft, the at least one wheel including a surface defining a bore for receiving the shaft and having a first part of a substantially axially extending keyway terminating at the surface of the wheel and the shaft having a second part of the keyway terminating at the periphery of the shaft, the first and second part of the keyway when appropriately registered for receiving a key, ventilation means for ventilating the keyway and the key to be disposed therein comprising:

first fluid flow communication means coupled to the keyway for providing fluid flow communication between the keyway and a first location on an axial end of the at least one wheel; and second fluid flow communication means coupled to the keyway for providing fluid flow communication between the keyway and a second location on the axial end of the at least one wheel such that at least part of the keyway forms a portion of the fluid flow communication from the first location to the second location.

2. Ventilation means as in claim 1, wherein the second fluid communication means includes at least part of a circumferential chamber disposed at the axial end of the keyway closer to the other axial end of the at least one wheel.

3. Ventilation means as in claim 1, wherein the second fluid communication means further includes a channel having a respective end terminating at the second location and the circumferential chamber, respectively.

4. Ventilation means as in claim 3, wherein the channel is defined at least in part by the shaft.

5. Ventilation means as in claim 4, wherein the channel is disposed in the radial inner portion of the at least one wheel and is defined in part by the periphery of the shaft.

6. Ventilation means as in claim 3, wherein the first location is substantially diametrically disposed from the second location.

7. In a steam turbine including a rotatable shaft and at least one wheel fixedly coupled to the shaft, the at least one wheel including a surface defining a bore for receiving the shaft and having a first part of a substantially axially extending keyway terminating at the surface of the wheel and the shaft having a second part of the keyway terminating at the periphery of the rotor, the first and second part of the keyway when appropriately registered for receiving a key, the steam turbine further including at least another wheel axially spaced from the at least one wheel and coupled to the shaft to form an interhub spacing therebetween the at least one wheel and the at least another wheel each respectively including opposing axially extending hubs and sealing means circumferentially surrounding at least a portion of the axially extending hubs and the included interhub spacing for forming an ancillary steam flow path between the periphery of the hubs and the sealing means, ventilation means for ventilating the keyway and the key to be disposed therein, comprising:

flow diverging means for directing at least a portion of steam flow in the ancillary steam flow path into the interhub spacing; first steam flow communication means coupled to the interhub spacing at a first location for providing steam flow communication between the interhub spacing and the keyway; and second steam flow communication means coupled to the interhub spacing at a second location for providing steam flow communication between the keyway and the second location such that at least a part of the keyway forms a portion of the steam flow communication between the first and second location.

8. Ventilation means as in claim 7, wherein the opposing hubs respectively include an opposing axial end surface intersecting the respective periphery of the hub and further wherein the intersection of the periphery of the hub and the axial end surface of the at least another wheel is radially foreshortened over a predetermined arcuate portion such that ancillary steam flow along the periphery of the hub of the another wheel is radially inwardly directed such that at least a portion of the ancillary steam flow strikes the axial end surface of the at least one wheel, whereby at least a portion of the ancillary steam flow is directed into the interhub spacing due to increased static pressure in the ancillary steam flow over the predetermined arcuate portion.

9. Ventilation means as in claim 7, wherein the opposing hubs respectively include an opposing axial end surface intersecting the respective periphery of the hub and further wherein the intersection of the periphery of the hub and the axial end surface of the at least one wheel is radially foreshortened over a predetermined arcuate portion such that ancillary steam flow along the periphery of the hub of the another wheel is directed such that the static pressure of the ancillary flow is reduced over the predetermined arcuate portion whereby at least a portion of the ancillary steam flow is directed into the interhub spacing due to increased static pressure in the ancillary steam flow over the predetermined arcuate portion.

10. Ventilation means as in claim 8, wherein the first location is disposed within the radial boundaries of the predetermined arcuate portion.

11. Ventilation means as in claim 9, wherein the second location is disposed within the radial boundaries of the predetermined arcuate portion.

12. Ventilation means as in claim 7, wherein the second steam flow communication means includes at least part of a circumferential chamber disposed at the axial end of the keyway closer to the other axial end of the at least one wheel.

13. Ventilation means as in claim 7, wherein the second steam flow communication means further includes a channel having a respective end terminating at the second location and the circumferential chamber, respectively.

14. Ventilation means as in claim 13, wherein the channel is defined at least in part by the shaft.

15. Ventilation means as in claim 14, wherein the channel is disposed in the radial inner portion of the at least one wheel and is defined in part by the periphery of the shaft.

16. Ventilation means as in claim 13, wherein the first location is substantially diametrically disposed from the second location.

17. A method for ventilating an axially disposed keyway for receiving a key to secure a wheel to a shaft of a steam turbine having an ancillary steam flow path circumferentially surrounding an axial end of the wheel comprising:

urging at least a portion of steam flow from the ancillary steam flow path of the turbine to flow along the keyway from the axial end of the wheel; and returning the at least a portion of steam flow to the axial end of the wheel.

18. The method as in claim 17, wherein the step of urging further includes creating a localized high pressure region in the ancillary steam flow path over a predetermined arcuate portion of the axial end of the wheel.

19. The method as in claim 17, wherein the step of urging further includes creating a localized low pressure region in the ancillary steam flow path over a predetermined arcuate portion of the axial end of the wheel.

20. The method as in claim 17, wherein the step of urging further includes creating a localized high pressure region in the ancillary steam flow path over a first predetermined arcuate portion of the end of the wheel and creating a localized low pressure region in the ancillary steam flow path over a second predetermined arcuate portion of the end of the wheel.

21. The method as in claim 20, wherein at least a part of the first predetermined arcuate portion and at least a part of the second predetermined arcuate portion are diametrically opposed.

* * * * *